US008704738B2

(12) United States Patent
Han et al.

(10) Patent No.: US 8,704,738 B2
(45) Date of Patent: Apr. 22, 2014

(54) ORGANIC LIGHT EMITTING DISPLAY DEVICE AND DRIVING METHOD THEREOF

(71) Applicant: Samsung Display Co., Ltd., Yongin (KR)

(72) Inventors: Sang-Myeon Han, Yongin (KR); Baek-Woon Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 13/896,248

(22) Filed: May 16, 2013

(65) Prior Publication Data

US 2013/0249889 A1 Sep. 26, 2013

Related U.S. Application Data

(62) Division of application No. 12/963,440, filed on Dec. 8, 2010, now Pat. No. 8,462,089.

(30) Foreign Application Priority Data

May 10, 2010 (KR) ..... 10-2010-0043504

(51) Int. Cl.
*G09G 3/32* (2006.01)

(52) U.S. Cl.
USPC ..... 345/82

(58) Field of Classification Search
USPC ..... 345/76–83, 211–212
See application file for complete search history.

(56) References Cited

U.S. PATENT DOCUMENTS

| | | | | |
|---|---|---|---|---|
| 2003/0107565 | A1 | 6/2003 | Libsch et al. | |
| 2006/0244695 | A1 | 11/2006 | Komiya | |
| 2007/0040773 | A1 | 2/2007 | Lee et al. | |
| 2007/0164959 | A1 | 7/2007 | Childs | |
| 2008/0198111 | A1 | 8/2008 | Yamashita et al. | |
| 2009/0109150 | A1 * | 4/2009 | Han et al. | 345/82 |
| 2009/0284519 | A1 | 11/2009 | Kim et al. | |

FOREIGN PATENT DOCUMENTS

| | | |
|---|---|---|
| JP | 2009-139820 | 6/2009 |
| JP | 2010-062767 A | 3/2010 |

(Continued)

OTHER PUBLICATIONS

KIPO Office Action dated Sep. 27, 2011 for KR Application No. 10-2010-0043504 (1 page).

*Primary Examiner* — Liliana Cerullo
(74) *Attorney, Agent, or Firm* — Christie, Parker & Hale, LLP

(57) ABSTRACT

An organic light emitting display device includes: a display unit including pixels coupled to scan lines and data lines; one or more control lines coupled to the pixels; a control line driver for supplying control signals to the pixels through the control lines; a first power driver for applying a first power having a low voltage level or a high voltage level to the pixels; and a second power driver for applying a second power having a low voltage level or a high voltage level to the pixels, in which each of the pixels includes: an organic light emitting diode (OLED); a driving transistor for controlling an amount of current supplied to the OLED; and an initializing transistor coupled to a gate electrode of the driving transistor and for supplying a reset voltage to the gate electrode of the driving transistor.

12 Claims, 9 Drawing Sheets

(56) References Cited

FOREIGN PATENT DOCUMENTS

| | | | |
|---|---|---|---|
| KR | 10-0675939 | B1 | 1/2007 |
| KR | 10-0739334 | B1 | 7/2007 |
| KR | 10-2009-0023639 | A | 3/2009 |
| KR | 10-2009-0058319 | A | 6/2009 |
| KR | 10-2009-0104664 | A | 10/2009 |

* cited by examiner

ORGANIC LIGHT EMITTING DISPLAY DEVICE AND DRIVING METHOD THEREOF

CROSS-REFERENCE TO RELATED APPLICATION

This application is a divisional of U.S. patent application Ser. No. 12/963,440, filed Dec. 8, 2010, which claims priority to and the benefit of Korean Patent Application No. 10-2010-0043504, filed May 10, 2010, the entire content of both of which is incorporated herein by reference.

BACKGROUND

1. Field

Embodiments of the present invention relate to an organic light emitting display device and a driving method thereof.

2. Description of Related Art

Recently, various flat panel displays that are capable of reducing disadvantages of cathode ray tubes, such as the weight and the volume, have been developed. Typical flat panel displays include liquid crystal displays, field emission displays, plasma display panels, organic light emitting display devices, etc.

Among the flat panel display devices, the organic light emitting display device displays an image using organic light emitting diodes that emit light by recombination of electrons and holes, and has high response speed and is driven at low power consumption.

In general, the organic light emitting display devices are classified into passive matrix organic light emitting display devices (PMOLEDs) or active matrix organic light emitting display devices (AMOLEDs), in accordance with the types or methods of driving the organic light emitting diodes.

The active matrix organic light emitting display device includes a plurality of scanning lines, a plurality of data lines, a plurality of power source lines, and a plurality of pixels coupled to the lines and arranged in a matrix. A pixel commonly includes an organic light emitting diode, a driving transistor for controlling the amount of current supplied to the organic light emitting diode, a switching transistor for transmitting a data signal to the driving transistor, and a storage capacitor for maintaining a voltage of the data signal.

An active matrix organic light emitting display device generally has low power consumption, but may exhibit a non-uniform display because the magnitude of current flowing through an organic light emitting element can vary due to a voltage difference between the gate and the drain of a driving transistor that drives the organic light emitting element—that is, a threshold voltage difference of the driving transistor.

That is, properties of the transistors disposed in pixels vary due to variability in the manufacturing process, and accordingly, the threshold voltages of the driving transistors differ between the pixels. A compensating circuit that can compensate for the threshold voltages of the driving transistors can be additionally formed to remove the non-uniformity between the pixels.

The compensating circuit, however, generally includes a plurality of transistors, capacitors and signal lines for controlling the transistors. Therefore, a pixel including such a compensating circuit may have a reduced aperture ratio and an increased probability of having a manufacturing defect.

SUMMARY

One embodiment of the present invention is directed to a pixel including two transistors and two capacitors. Another embodiment provides an organic light emitting display device that can display an image with desired luminance regardless of the threshold voltage of a driving transistor by operating pixels in a concurrent emission method, and a method of driving the organic light emitting display device.

In one embodiment of the present invention, an organic light emitting display device includes: a display unit including a plurality of pixels coupled to a plurality of scan lines and a plurality of data lines; one or more control lines coupled to the pixels; a control line driver for supplying a plurality of control signals to the pixels through the one or more control lines; a first power driver for applying a first power having a low voltage level and a high voltage level to the pixels; and a second power driver for applying a second power having a low voltage level and a high voltage level to the pixels, in which each of the pixels includes: an organic light emitting diode; a driving transistor for controlling an amount of current supplied to the organic light emitting diode; and an initializing transistor coupled to a gate electrode of the driving transistor and configured to be turned on during a reset period of one frame period to supply a reset voltage to the gate electrode of the driving transistor, the reset voltage having a voltage lower than the high voltage level of the first power.

The organic light emitting display device may further include: a scan driver for supplying a plurality of scan signals to the scan lines; a data driver for supplying a plurality of data signals to the data lines in synchronization with the scan signals; and a timing controller for controlling the scan driver, the data driver, and the control line driver. One frame period may include the reset period, a threshold voltage compensation period, a scan period, and an emission period, and the scan driver may be configured to sequentially supply the scan signals to the scan lines during the scan period and to concurrently supply the scan signals to the scan lines during the threshold voltage compensation period. The data driver may be configured to supply the data signals to the data lines during the scan period and to supply a first voltage to the data lines during the reset period, the threshold voltage compensation period, and the emission period.

The first voltage may be the voltage of any one data signal of the data signals for implementing a plurality of gradations. The control line driver may be configured to supply control signals to the control lines during a portion of the reset period, and the threshold voltage compensation period. The first power driver may be configured to supply the first power at the low voltage level during the reset period and to supply the first power at the high voltage level during the threshold voltage compensation period, the scan period, and the emission period. The second power driver may be configured to supply the second power at the high voltage level during the reset period, the threshold voltage compensation period, and the scan period, and to supply the second power at the low voltage level during the emission period.

According to another aspect of the present invention, there is provided a method of driving an organic light emitting display device including a plurality of pixels, each of the pixels including an organic light emitting diode, a driving transistor for controlling an amount of current supplied to the organic light emitting diode, and an initializing transistor coupled to a gate electrode of the driving transistor. The method according to this embodiment includes: initializing, concurrently, the gate electrodes of the driving transistors and the anode electrodes of the organic light emitting diodes of the pixels during a reset period; charging, concurrently, a second capacitor of each of the pixels with a voltage corresponding to a threshold voltage of the corresponding driving transistor during a threshold voltage compensation period;

selecting the pixels of each horizontal line and charging a first capacitor of each of the pixels with a voltage corresponding to a corresponding data signal of the data signals during a scan period; and producing light in accordance with the amount of current supplied to a second power driver from a first power driver through the organic light emitting diode in accordance with the voltages of the first capacitor and the second capacitor during an emission period, wherein the voltages of the gate electrodes of the driving transistors are initialized to a reset voltage by turning on the initializing transistor during the reset period.

According to an organic light emitting display device and a method of driving the organic light emitting display device of embodiments of the present invention, it is possible to compensate for the threshold voltages of driving transistors of pixels, using pixels including four transistors and two capacitors. Further, embodiments of the present invention can stably display a 3D image using a concurrent (e.g., simultaneous) emission method.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
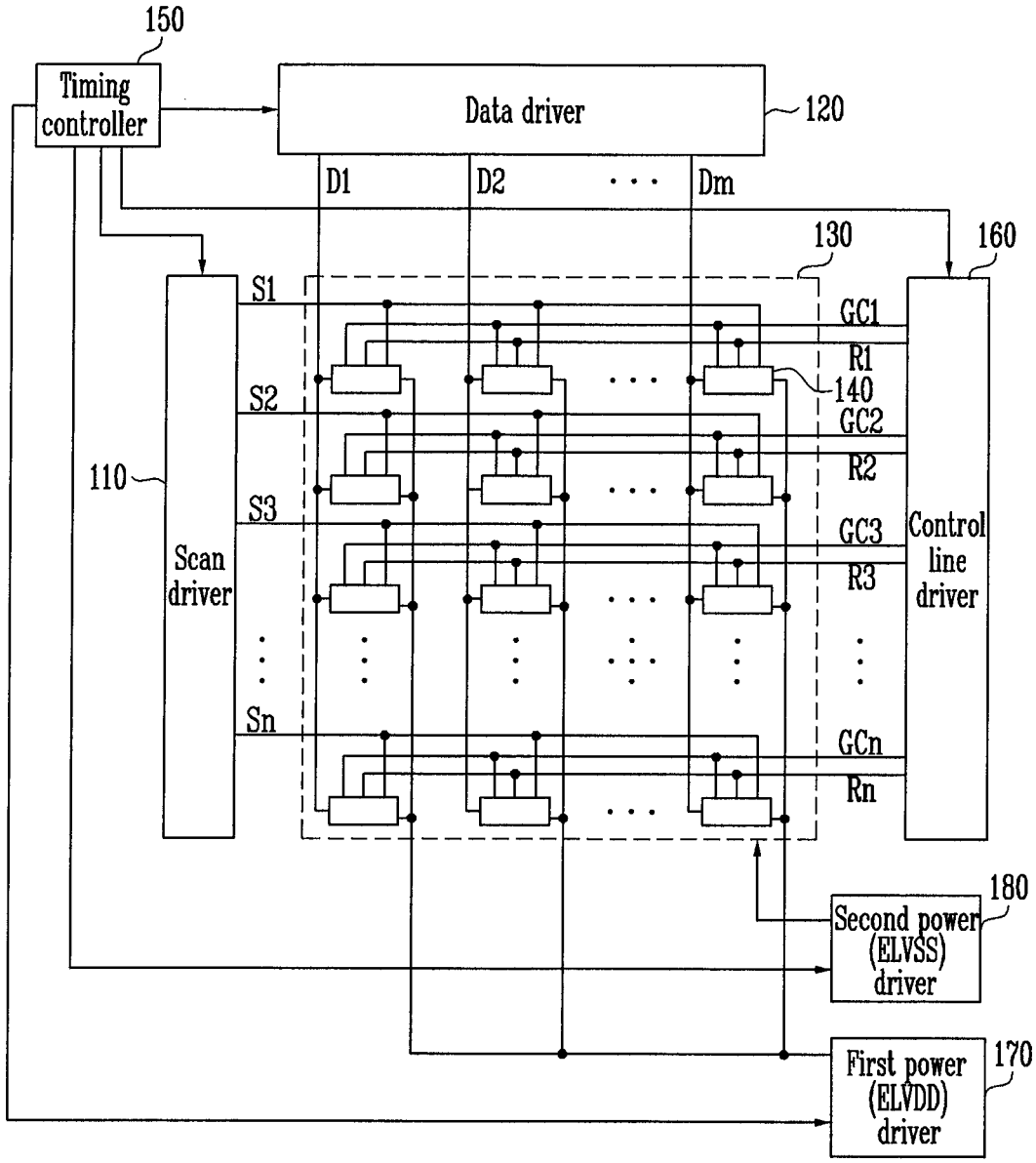
FIG. 1 is a block diagram illustrating an organic light emitting display device according to an embodiment of the present invention.

Hereinafter, certain exemplary embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to the complete understanding of the invention are omitted for clarity. Also, like reference numerals refer to like elements throughout.

Exemplary embodiments of the present invention are described in detail with reference to FIGS. 1 to 8.

FIG. 1 is a block diagram illustrating an organic light emitting display device according to an embodiment of the present invention.

Referring to FIG. 1, an organic light emitting display device includes: a display unit 130 including pixels 140 coupled to scan lines S1 to Sn, control lines GC1 to GCn, reset lines R1 to Rn, and data lines D1 to Dm; a scan driver 110 for supplying scan signals to the scan lines S1 to Sn; a control line driver 160 for supplying control signals and reset signals to the control lines GC1 to GCn and the reset lines R1 to Rn, respectively; a data driver 120 for supplying data signals to the data lines D1 to Dm; and a timing controller 150 for controlling the scan driver 110, the data driver 120, and the control line driver 160.

Further, an organic light emitting display device according to an embodiment of the present invention includes a first power driver (or first power supply) 170 for supplying a power of a first power supply ELVDD to the pixels 140 and a second power driver (or second power supply) 180 for supplying a power of a second power supply ELVSS to the pixels 140.

The scanning driver 110 supplies scanning signals to the scanning lines S1 to Sn. In this configuration, the scan driver 110 concurrently (e.g., simultaneously) supplies scan signals to the scan lines S1 to Sn during a threshold voltage compensation period in one frame period, and sequentially supplies scan signals to the scan lines S1 to Sn during a scan period.

The data driver 120 supplies data signals to the data lines D1 to Dm to be synchronized with the scan signals sequentially supplied to the scan lines S1 to Sn during the scan period.

The control line driver 160 supplies controls signals and reset signals to the control lines GC1 to GCn and the reset lines R1 to Rn, respectively. In this configuration, the control line driver 160 supplies reset signals to the reset lines R1 to Rn during a reset period in one frame period. Further, the control line driver 160 supplies control signals to the control lines GC1 to GCn during a period (e.g., a predetermined period) in the reset period and the threshold voltage compensation period.

The reset lines R1 to Rn and the control liens GC1 to GCn are concurrently supplied with the same signals, respectively, in embodiments according to the present invention. Therefore, in one embodiment, one reset line and one control line may be coupled to all of the pixels 140. In another embodiment, one or more reset lines and one or more control lines may be formed to be coupled to the pixels.

The display unit 130 includes pixels 140 located at the crossing regions of the scan lines S1 to Sn and the data lines D1 to Dm. The pixels 140 are supplied with power from the first power supply ELVDD and the second power supply ELVSS. The pixels 140 controls the amount of current supplied to a second power supply ELVSS through the organic light emitting diodes from a first power supply ELVDD, in response to (or in accordance with) the data signals during the emission period in one frame period. Accordingly, light having a luminance (e.g., a predetermined luminance) is generated in the organic light emitting diode.

The first power driver 170 supplies a power of the first power supply ELVDD to the pixels 140. In this configuration, the first power driver 170 supplies a high voltage level power (or high-level power) of the first power supply ELVDD during the threshold voltage compensation period, the scan period, and the emission period and supplies a low voltage level power (or low-level power) of the first power supply ELVDD during the other periods.

The second power driver 180 supplies a power of the second power supply ELVSS to the pixels 140. The second power generator 180 supplies a high voltage level power (or a high-level power) of the second power supply ELVSS during the reset period, the threshold compensation period, and the scan period and supplies a low voltage level power (or a low-level power) of the second power supply ELVSS during the emission period. In this configuration, current is not supplied to the organic light emitting diodes and accordingly the pixels 140 are in a non-emission state during the reset period, the threshold voltage compensation period, and the scan period, when the high voltage level power is supplied from the second power supply ELVSS.

Figure 2:
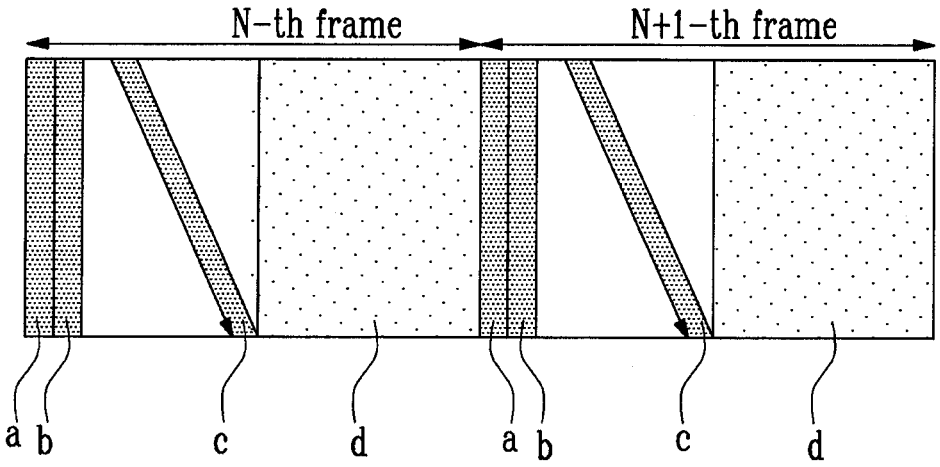
FIG. 2 is a diagram illustrating the operation in a concurrent (e.g., simultaneous) emission method according to an embodiment of the present invention.

FIG. 2 is a diagram illustrating a method of driving an organic light emitting display device according to an embodiment of the present invention.

Referring to FIG. 2, the organic light emitting display device according to an embodiment of the present invention operates in a concurrent (e.g., simultaneous) emission method. In general, driving methods are classified into progressive emission or concurrent emission methods. The progressive emission method implies a method of sequentially supplying (or inputting) data to horizontal lines of pixels and sequentially emitting light from the pixels in each horizontal line in the same order that the data was supplied.

The concurrent emission method implies a method of sequentially supplying data for each horizontal line and concurrently emitting light from the pixels after the data is supplied to all of the pixels. According to one embodiment of the present invention, one frame driven in the concurrent emission method is divided into (a) a reset period, (b) a threshold voltage compensation period, (c) a scan period, and (d) an emission period. In one embodiment, the pixels 140 are sequentially driven for each scan line (e.g., one scan line or horizontal row of pixels at a time) during (c) the scan period, and all the pixels 140 are concurrently driven during (a) the reset period, the (b) threshold voltage compensation period, and (d) the emission period.

(a) The reset period is a period in which the voltages of the driving transistors and the anode electrodes of the organic light emitting diodes, which are included in the pixels 140, are initialized to the voltage of a reset power. In this configuration, the reset power is set smaller (or lower) than the voltage of the high voltage level of the first power and the high voltage level of the second power. For example, the voltage of the reset power may be set the same as or smaller than the voltage of the low voltage level second power source ELVSS such that the gate electrode of the driving transistor can be stably initialized.

(b) The threshold voltage compensation period is a period in which the threshold voltage of the driving transistors is compensated for. Second capacitors included in the pixels 140 are charged with voltages corresponding to the threshold voltages of the driving transistors during the threshold voltage compensation period.

(c) The scan period is a period in which a data signal is supplied to the pixels 140. First capacitors included in the pixels 140 are charged at voltages corresponding to the data signal during the scan period.

(d) The emission period is a period in which the pixels 140 emit light in response to the data signal supplied during the scan period.

As described above, according to a driving method according to one embodiment of the present invention, it is possible to reduce the number of transistors in compensating circuits in the pixels 140 and signal lines, because the operational periods (a) to (d) are separated in terms of time. Further, it is easy to implement a shutter spectacles type 3D display, because the operational periods (a) to (d) are clearly separated in terms of time.

The shutter spectacles type 3D display alternately outputs left-eye and right-eye images for each frame. A user wears "shutter spectacles", of which the left-eye and right-eye transmittances switch in the range of 0% to 100%. The shutter spectacles supply the left-eye image and the right-eye image to the left eye and the right eye, respectively, such that the user recognizes a stereoscopic image.

Figure 3:
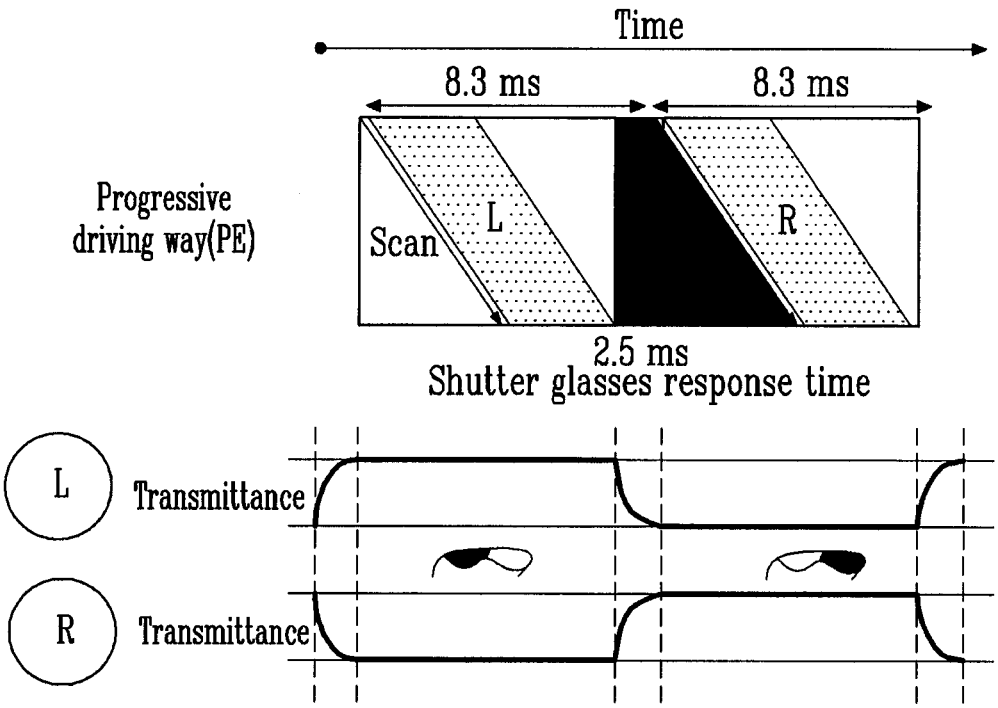
FIG. 3 is a diagram illustrating an example implementing a shutter spectacles type 3D display in a progressive emission method.

FIG. 3 is a diagram illustrating an example implementing a shutter spectacles type 3D display in a progressive emission method.

Referring to FIG. 3, emission should be stopped for the response time of the shutter spectacles (e.g., 2.5 ms) in order to prevent cross talk between the left-eye/right-eye images, when a screen is outputted by the progressive emission method. That is, a non-emission period is additionally provided for at least as much as the response time of the shutter spectacles between the frame (e.g., ith-frame, where i is a natural number) outputting the left-eye image and the frame (e.g., i+1th-frame) outputs the right-eye image, such that emission duty ratio decreases.

Figure 4:
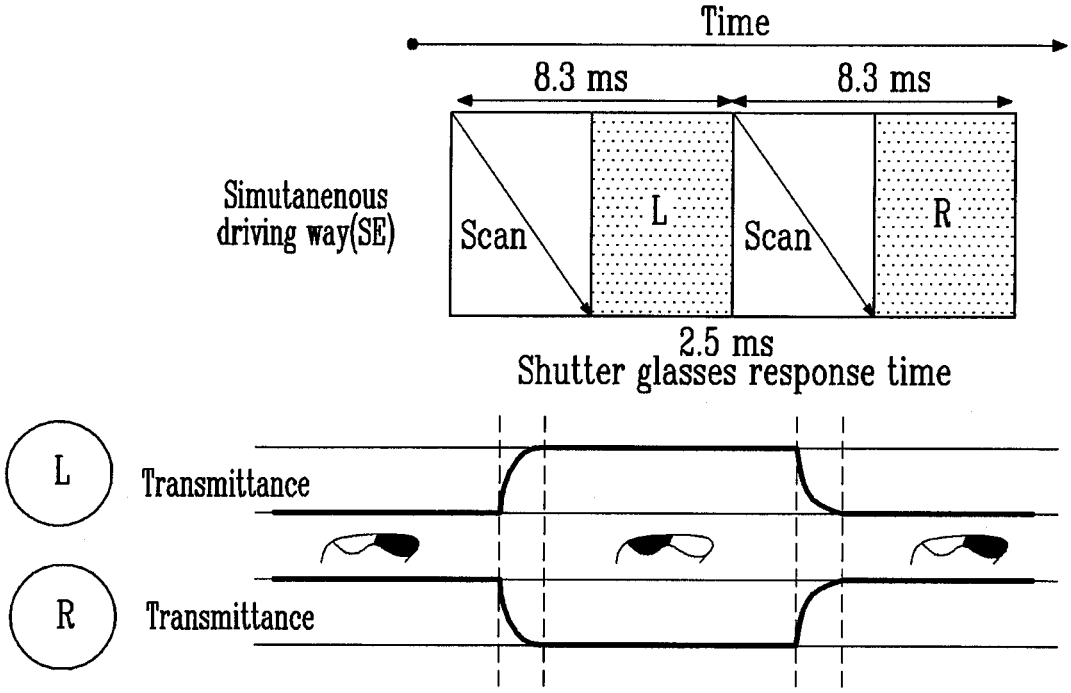
FIG. 4 is a diagram illustrating an example of implementing a shutter spectacles type 3D display in a concurrent (e.g., simultaneous) emission method according to an embodiment of the present invention.

FIG. 4 is a diagram illustrating an example of implementing a shutter spectacles type 3D display in a concurrent emission method according to an embodiment of the present invention.

Referring to FIG. 4, light is concurrently emitted from the entire display unit and the pixels are set to a non-emission state in periods except for the emission period, when a screen is outputted in the concurrent emission method. Therefore, a non-emission period can be naturally ensured between the left-eye image output period and the right-eye image output period.

That is, the pixels 140 are set to the non-emission state for the reset period, threshold voltage compensation period, and scan period, between the ith-frame and the i+1th-frame and these periods can be synchronized with the response time of the shutter spectacles without reducing the emission duty ratio, unlike the progressive emission method of the related art.

Figure 5:
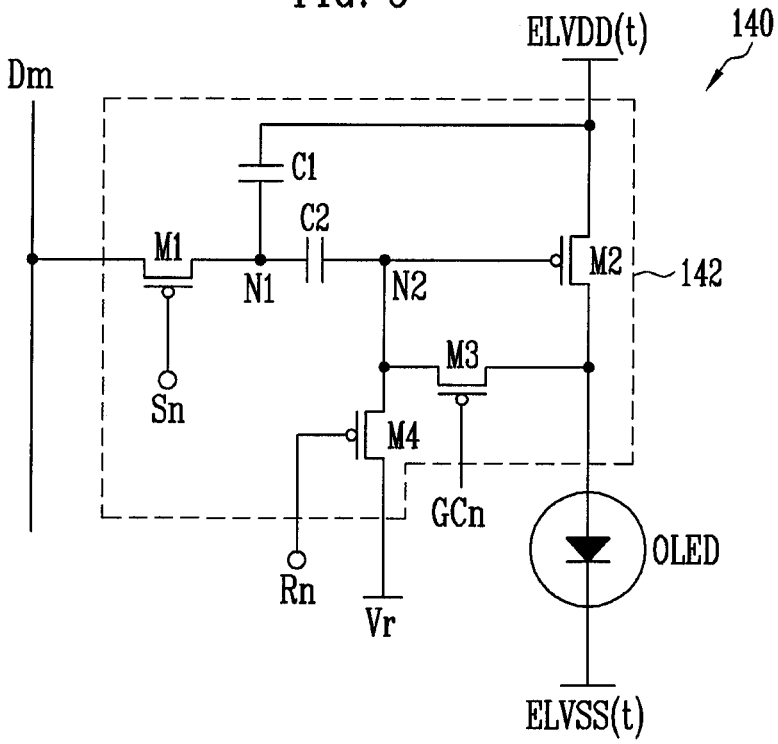
FIG. 5 is a diagram illustrating a first embodiment of a pixel shown in FIG. 1.

FIG. 5 is a circuit diagram illustrating a first embodiment of a pixel shown in FIG. 1. A pixel coupled to an n-th scan line Sn and an m-th data line Dm is shown in FIG. 5, for convenience of description.

Referring to FIG. 5, the pixel 140 according to the first embodiment of the present invention includes an organic light emitting diode OLED and a pixel circuit 142 for controlling the amount of current supplied to the organic light emitting diode OLED.

The anode electrode of the organic light emitting diode OLED is coupled to the pixel circuit 142 and the cathode electrode is coupled to the second power supply ELVSS. The organic light emitting diode OLED produces light with a luminance (e.g., a predetermined luminance) in response to (or in accordance with) the current supplied from the pixel circuit 142.

The pixel circuit 142 is charged with a voltage corresponding to a data signal and the threshold voltage of the driving transistor and controls the amount of current supplied to the organic light emitting diode OLED in accordance with the charged voltage. In this embodiment, the pixel circuit 140 includes four transistors M1 to M4 and two capacitors C1 and C2.

A gate electrode of the first transistor M1 is coupled to the scan line Sn and a first electrode is coupled to the data line Dm. Further, a second electrode of the first transistor M1 is coupled to a first node N1. The first transistor M1 is turned on and electrically connects the data line Dm with the first node N1 when the scan signal is supplied to the scan line Sn.

A gate electrode of the second transistor M2 (driving transistor) is coupled to a second node N2 and a first electrode is coupled to the first power supply ELVDD. Further, a second electrode of the second transistor M2 is coupled to the anode of the organic light emitting diode OLED. The second transistor M2 controls the amount of current supplied to the organic light emitting diode OLED in response to (or in accordance with) the voltage applied to the second node N2.

A first electrode of the third transistor M3 is coupled to the second electrode of the second transistor M2 and a second electrode is coupled to second node N2. Further, a gate electrode of the third transistor M3 is coupled to a control line GCn. The third transistor M3 is turned on and diode-connects the second transistor M2 when a scan signal is supplied to the control line GCn.

A first electrode of the fourth transistor M4 is coupled to the second node N2 and a second electrode is coupled to a reset power supply Vr. Further, a gate electrode of the fourth transistor M4 is coupled to a reset line Rn. The fourth transistor M4 is turned on and supplies a voltage of the reset power supply Vr to the second node N2 when a reset signal is supplied to the reset line Rn.

The first capacitor C1 is coupled between the first node N1 and the first power supply ELVDD. The first capacitor C1 is charged with a voltage corresponding to the data signal.

The second capacitor C2 is coupled between the first node N1 and the second node N2. The second capacitor C2 is charged with a voltage corresponding to the threshold voltage of the second transistor M2.

FIGS. 6A to 6E are diagrams illustrating a method of driving the pixel shown in FIG. 5. The first power supply ELVDD is set at (or outputs) a low voltage level during a reset period and at a high voltage level during the threshold voltage compensation period, the scan period, and the emission period. The second power supply ELVSS is set at (or outputs) a high voltage level during the reset period, the threshold voltage compensation period, and the scan period and at a low voltage level during the emission period. In this configuration, the pixels 140 emit light during the period where the first power supply ELVDD is set at a high voltage level and the second power supply ELVSS is set at (or outputs) a low voltage level, that is, during only the emission period.

Figure 6A:
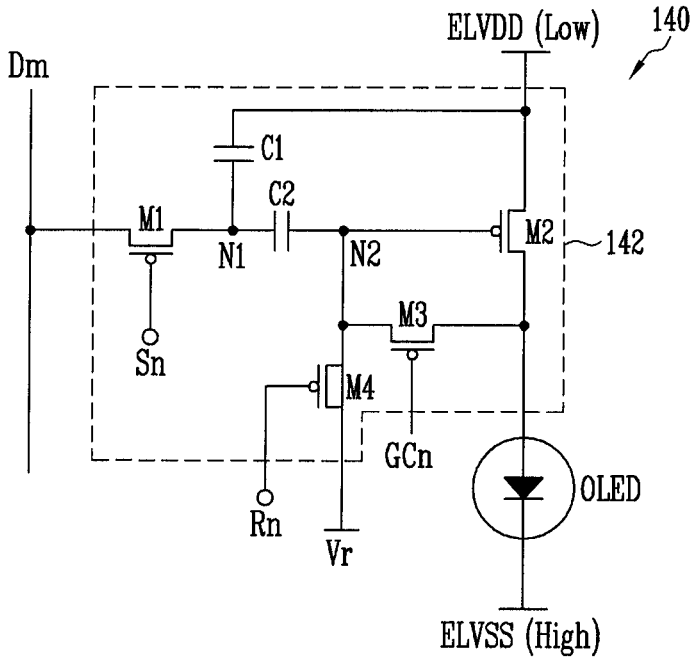
FIGS. 6A to 6E are diagrams illustrating a method of driving the pixel shown in FIG. 5.
Figure 6A:
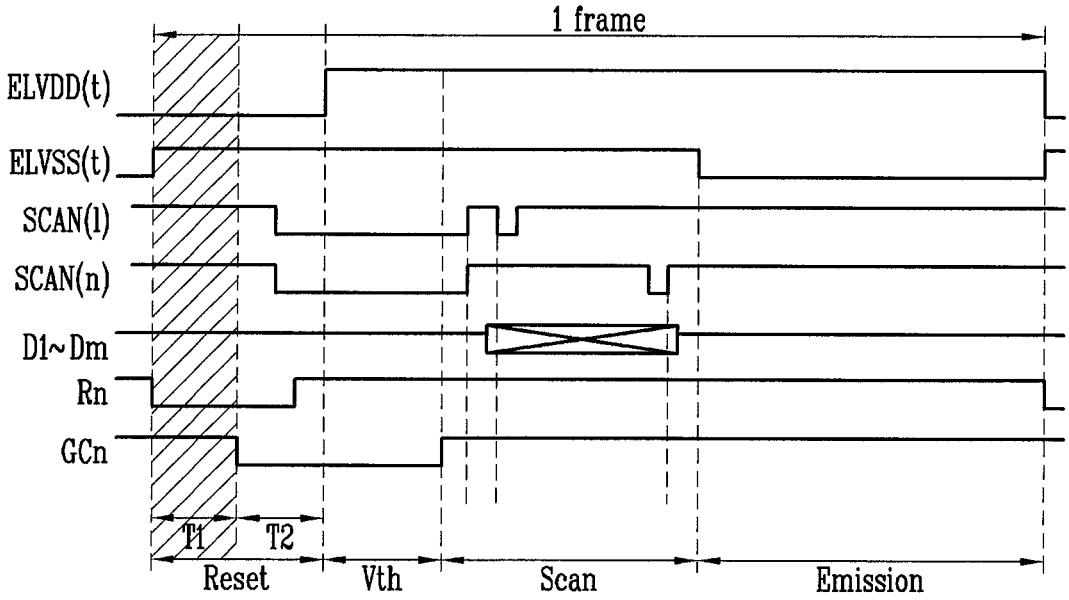

Referring to FIG. 6A, a reset signal is supplied to the reset line Rn during the reset period. Further, a control signal is not supplied to the control line GCn during a first period T1 in the reset period.

When the reset signal is supplied to the reset line Rn, the fourth transistor M4 is turned on. When the fourth transistor M4 is turned on (as shown in FIG. 6A with a line between the source and drain electrodes of the fourth transistor M4), the voltage of the reset power supply Vr is supplied to the second node N2. That is, second node N2 is initialized to the voltage of the reset power supply Vr during a first period T1 in the reset period.

Figure 6B:
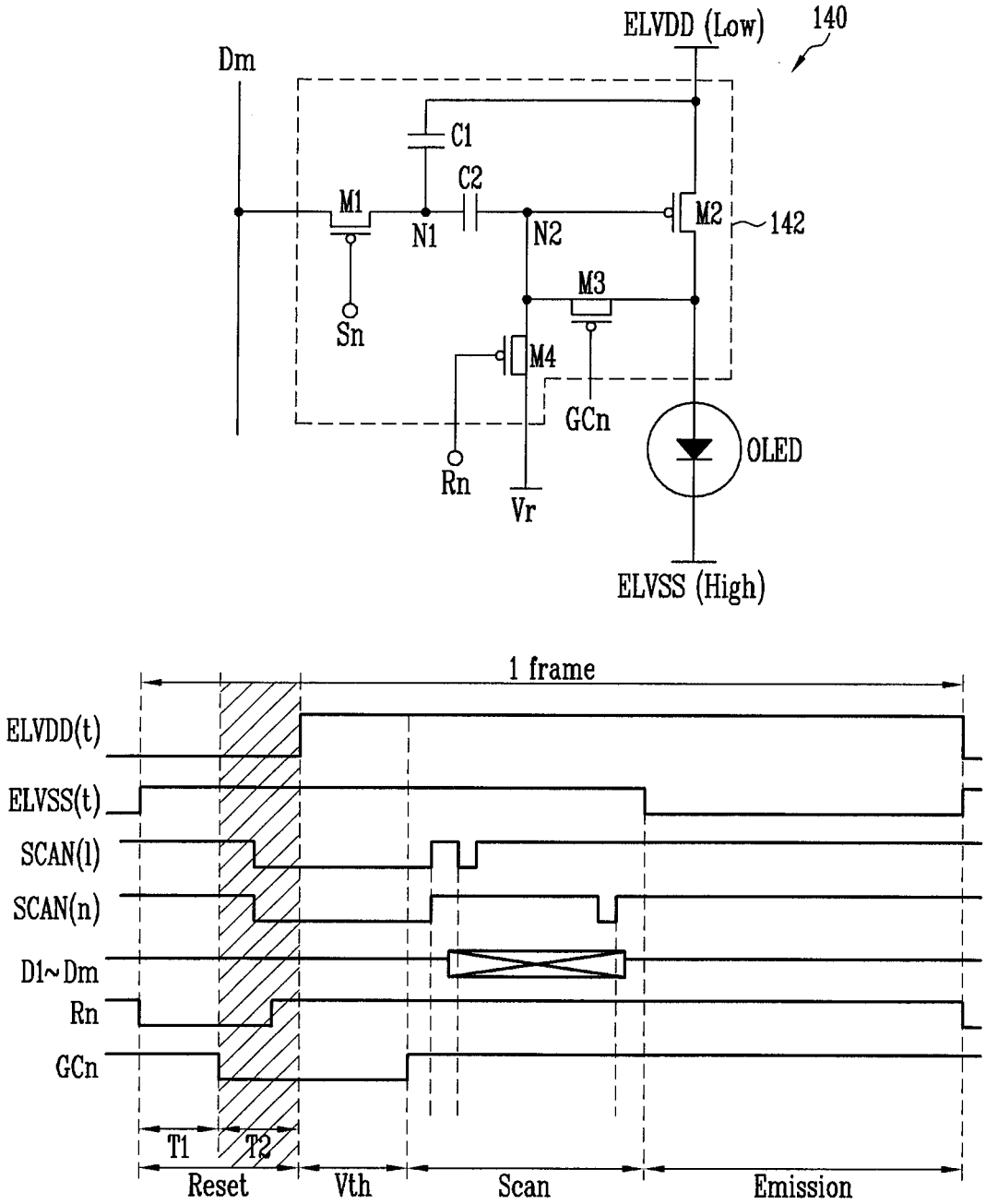

A control signal is supplied to the control line GCn during a second period T2 in the reset period, as shown in FIG. 6B. When the control signal is supplied to the control line GC, the third transistor M3 is turned on (as shown in FIG. 6B with a line between the source and drain electrodes of the third transistor M3). When the third transistor M3 is turned on, the voltage of the reset power supply Vr is supplied to the anode electrode of the organic light emitting diode OLED. In this case, the anode electrode of the organic light emitting diode OLED is initialized to the voltage of the reset power supply Vr.

As described above, the second node N2 and the anode electrode of the organic light emitting diode OLED are initialized to the voltage of the reset power supply Vr during the reset period.

Figure 6C:
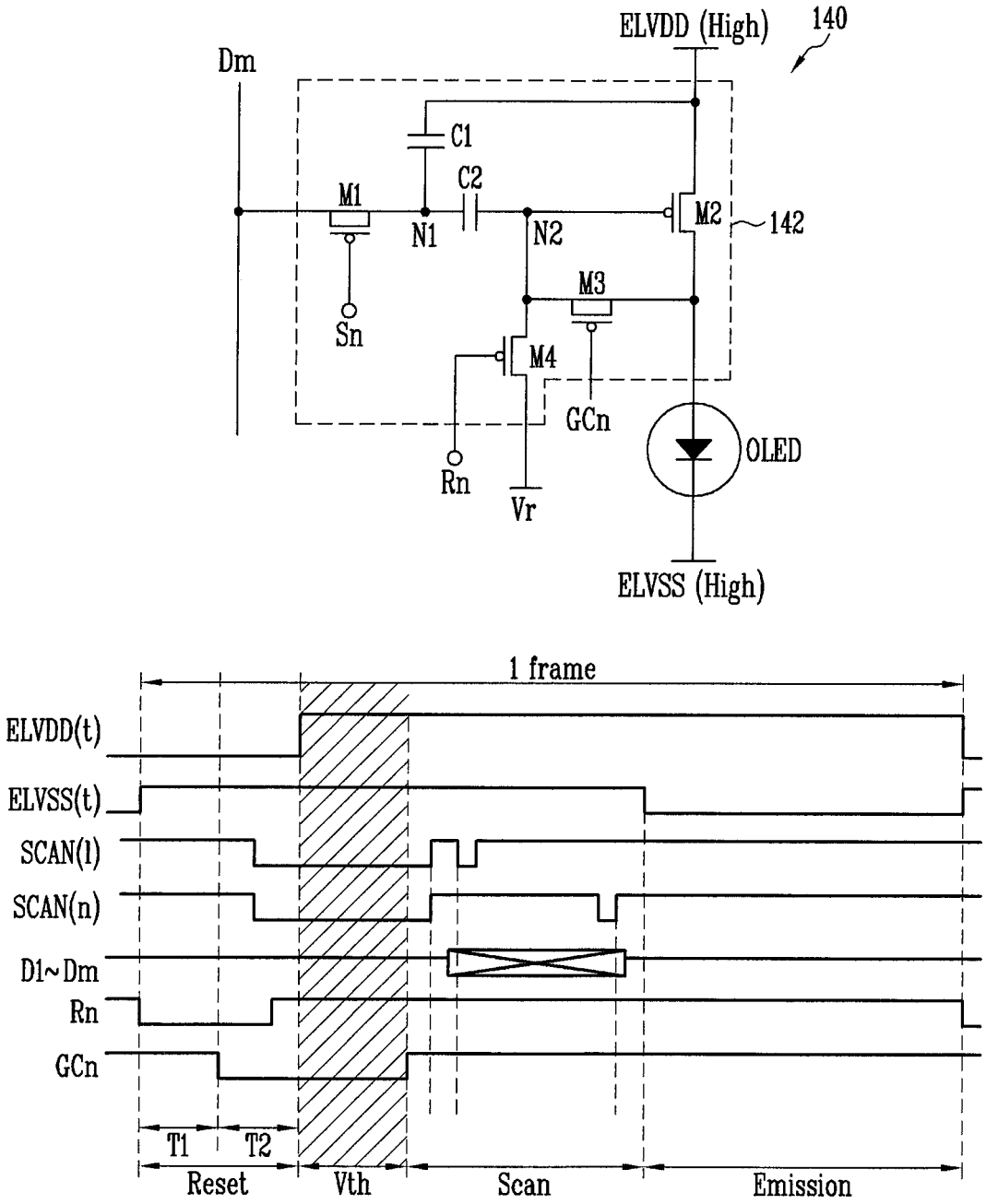

In the threshold voltage compensation period (Vth) after the reset period, as shown in FIG. 6C, the control signal continues to be supplied to the control line GCn and the third transistor M3 continues to be turned on. Further, the supply of the reset signal to the reset line Rn is stopped and the fourth transistor M4 is turned off during the threshold voltage compensation period.

The second transistor M2 is diode-connected when the third transistor M3 is turned on. In this process, the second transistor M2 is turned on because the voltage of the second node N2 is initialized to the voltage of the reset power Vr. When the second transistor M2 is turned on, the voltage of the second node N2 increases to a level obtained by subtracting the absolute value of the threshold voltage of the second transistor M2 from the high voltage level (or the high-level voltage) of the first power supply ELVDD. The second transistor M2 is turned off after the voltage of the second node N2 rises to the level obtained by subtracting the absolute value of the threshold voltage of the second transistor M2 from the voltage of the first power supply ELVDD.

A scan signal is supplied to the scan line Sn during the threshold voltage compensation period. When the scan signal is supplied to the scan line Sn, the first transistor M1 is turned on (as shown in FIG. 6C with a line between the source and drain electrodes of the first transistor M1). The data line Dm and the first node N1 are electrically connected when the first transistor M1 is turned on. In this process, a voltage (e.g., a first voltage or a predetermined voltage) is supplied to the data lines D1 to Dm. For example, the voltage may be set to the voltage of any one data signal of a plurality of data signals.

During the threshold voltage compensation period, the second capacitor C2 is charged with the voltage between the first node N1 and the second node N2, that is, a voltage corresponding to the threshold voltage of the second transistor M2. In other words, the voltage (e.g., the first voltage or the predetermined voltage) supplied to the first node N1 is set at the same level in all of the pixels 140, but the voltage supplied to the second node N2 is differently set for each of the pixels 140, because the voltage at N2 corresponds to the threshold voltage of the second transistor M2. Therefore, the voltage of the charged second capacitor C2 depends on the threshold voltage of the second transistor M2, such that it is possible to compensate for a threshold voltage difference of the second transistor M2.

Figure 6D:
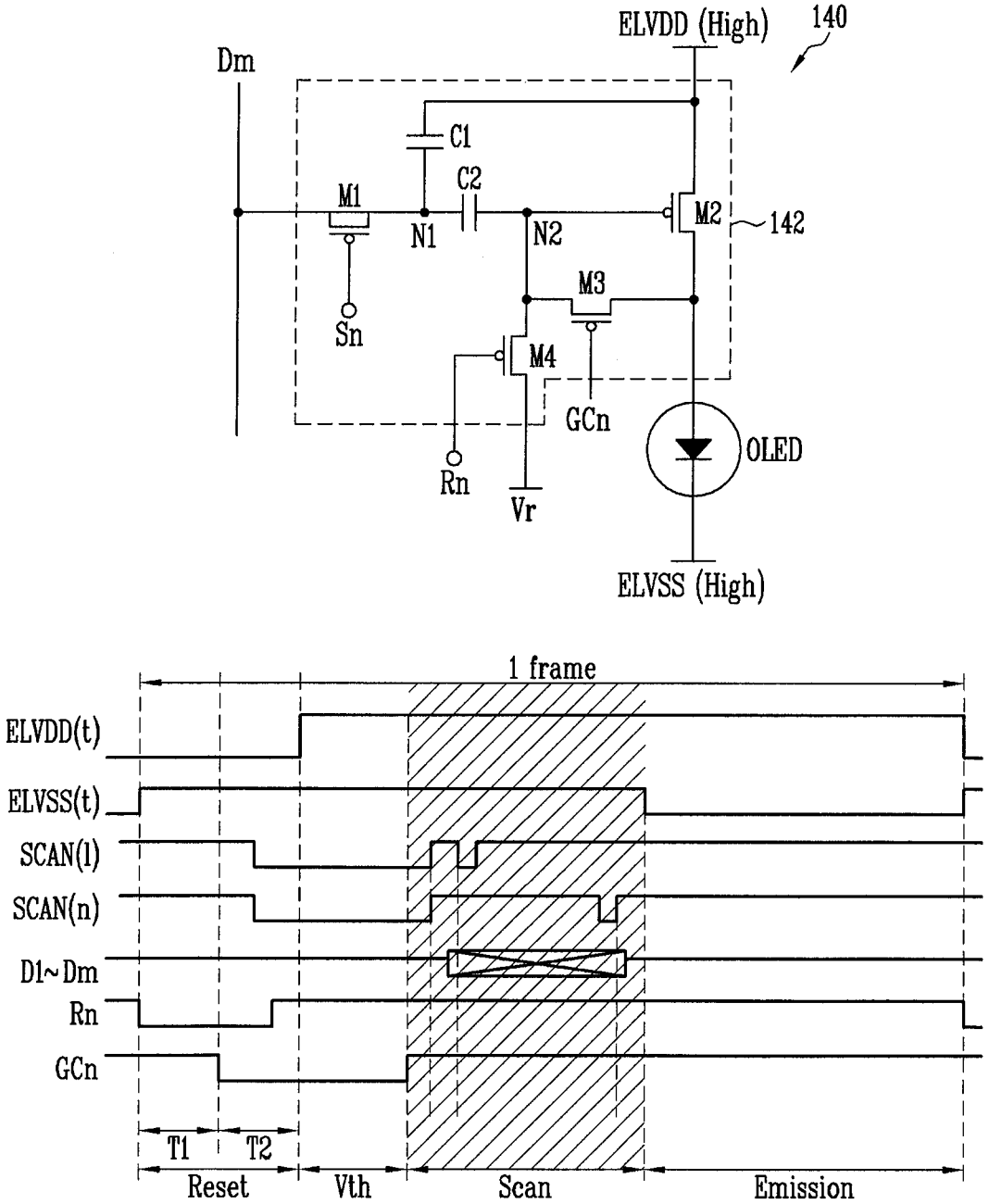

The scan signals are sequentially applied to the scan lines S1 to Sn, as shown in FIG. 6D, and the data signals are supplied to the data lines D1 to Dm in synchronization with the scan signals. When a scan signal is supplied to the scan line Sn, the first transistor M1 is turned on. A data signal from the data line Dm is supplied to the first node N1 when the first transistor M1 is turned on. In this process, the first capacitor C1 is charged at a voltage (e.g., a predetermined voltage) in response to the data signal. Meanwhile, the second node N2 is set to a floating state during the scan period such that the charged second capacitor C2 maintains the level provided in the previous period, regardless of voltage changes of the first node N1.

Figure 6E:
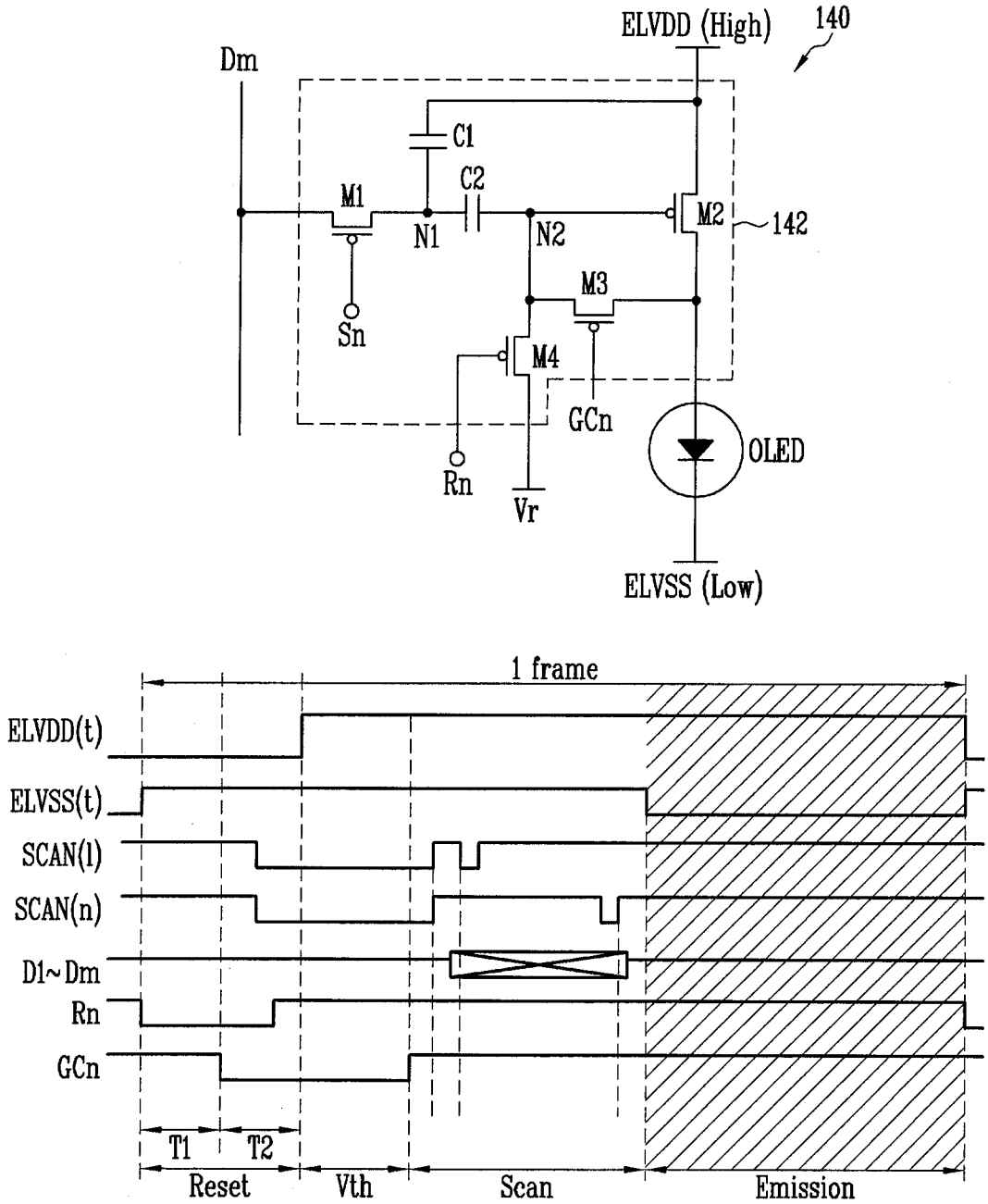

The low voltage level power of the second power supply ELVSS is supplied during the emission period, after the scan period, as shown in FIG. 6E. In this case, the second transistor M2 controls the amount of current flowing to the organic light emitting diode OLED in response to (or in accordance with) the voltage of the charged first and second capacitors C1 and C2. Therefore, an image with a luminance (e.g., a predetermined luminance) corresponding to the data signal is displayed in the display unit 130 during the emission period.

Figure 7:
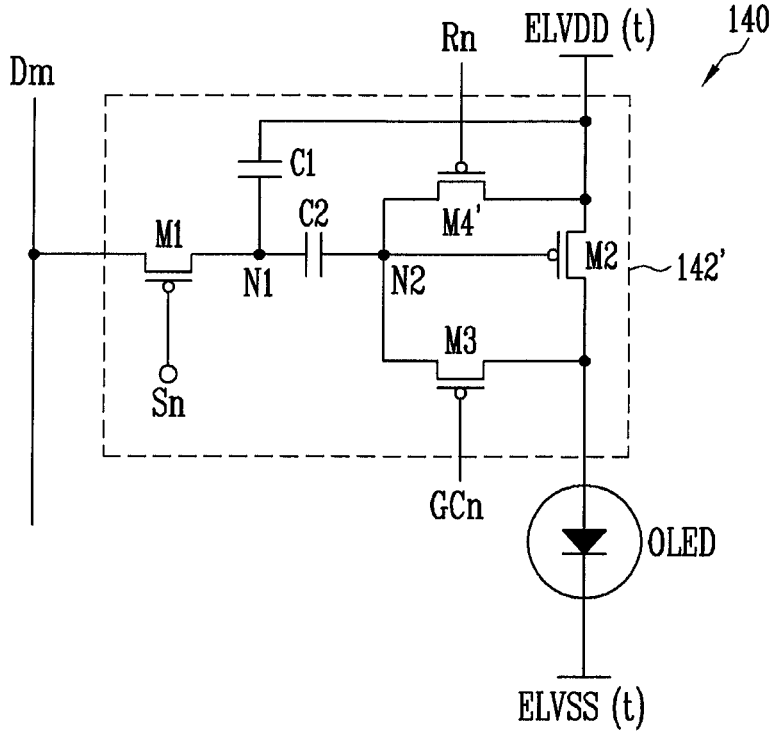
FIG. 7 is a diagram illustrating a second embodiment of a pixel shown in FIG. 1.

FIG. 7 is a circuit diagram illustrating the configuration of a pixel shown in FIG. 1 according to a second embodiment of the present invention. In describing the embodiment of FIG. 7, the same components as in FIG. 5 are designated by the same reference numerals and the detailed description thereof is not provided.

Referring to FIG. 7, the pixel 140 according to the second embodiment of the present invention includes an organic light emitting diode OLED and a pixel circuit 142' for controlling the amount of current supplied to the organic light emitting diode OLED.

A first electrode of the fourth transistor M4' included in the pixel circuit 142' is coupled to a gate electrode of the second transistor M2 and a second electrode is coupled to the a first electrode of the second transistor M2. Further, the gate electrode of the fourth transistor M4' is coupled to a reset line Rn. The fourth transistor M4 is turned on and electrically connects the first power supply ELVDD with the gate electrode of the second transistor M2, when a reset signal is supplied to the reset line Rn.

The fourth transistor M4' is turned on and changes the voltage of the second node N2 to the low voltage level of the first power supply ELVDD, during the reset period. Further, the third transistor M3 is turned on and the voltage of the organic light emitting diode OLED changes to the voltage of the first power supply ELVDD at a low level during the reset period.

That is, the pixel 140 according to the second embodiment of the present invention initializes the second node N2 and the anode electrode of the organic light emitting diode OLED, using the low voltage of the first power supply ELVDD, without using a specific (or separate) reset power supply. In this case, since the reset power supply is removed, a power line for connecting the reset power supply with the fourth transistor M4' is not used, thereby reducing the complexity of the circuit. In addition, the pixel 140 according to the second embodiment of the present invention initializes the second node N2 and the anode electrode of the organic light emitting diode OLED using the low voltage of the first power supply ELVDD and the other aspects of the driving method are the same as the pixel shown in FIG. 5 and the detailed description thereof is not provided.

Figure 8:
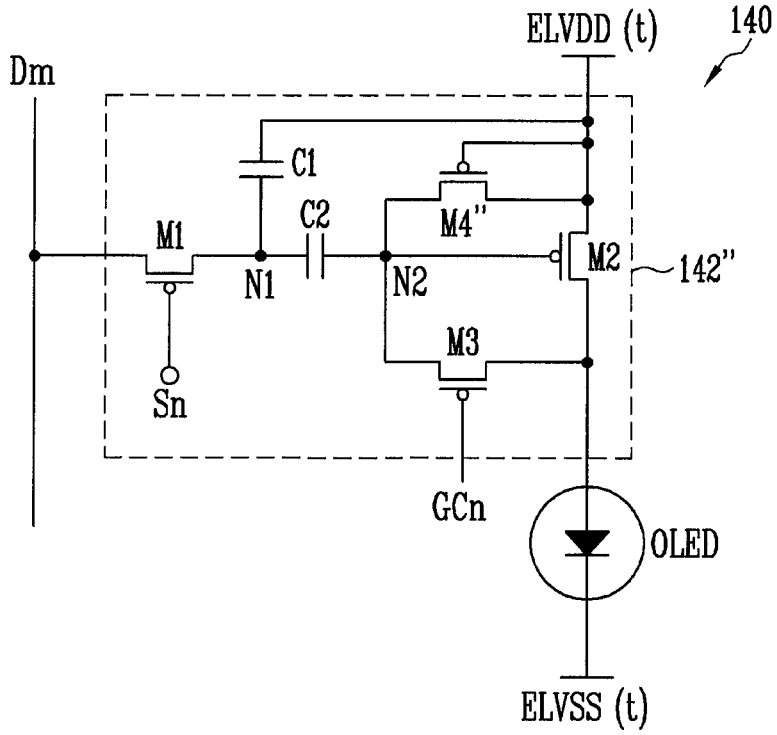
FIG. 8 is a diagram illustrating a third embodiment of a pixel shown in FIG. 1.

FIG. 8 is a circuit diagram illustrating the configuration of a pixel shown in FIG. 1 according to a third embodiment of the present invention. In explaining FIG. 8, the same components as in FIG. 5 are designated by the same reference numerals and the detailed description is not provided.

Referring to FIG. 8, the pixel 140 according to the third embodiment of the present invention includes an organic light emitting diode OLED and a pixel circuit 142" for controlling the amount of current supplied to the organic light emitting diode OLED.

A first electrode of the fourth transistor M4" included in the pixel circuit 142" is coupled to a gate electrode of the second transistor M2 and a second electrode and a gate electrode are both coupled to the first electrode of the second transistor M2. That is, the fourth transistor M4" is diode-connected such that current can flow from the second node N2 to the first power supply ELVDD.

When the fourth transistor M4" is diode-connected, the voltage of the second node N2 is set in reference to the low voltage level of the first power supply ELVDD during the period in which the low voltage level power of the first power supply ELVDD is supplied, that is, during the reset period (the voltage of the second node N2 is set substantially higher than the first power supply at a low level, because of the threshold voltage of the fourth transistor M4"). Further, the voltage of the anode electrode of the organic light emitting diode OLED is also initialized to substantially the low voltage level of the first power supply ELVDD during the second period in the reset period, when the third transistor M3 is turned on.

That is, the pixel 140 according to the third embodiment of the present invention initializes the second node N2 and the anode electrode of the organic light emitting diode OLED, using the fourth transistor M4", which is diode-connected, without using a specific (or separate) reset power supply and a reset line. In this case, the reset power supply and the reset line are removed. Meanwhile, the pixel 140 according to the second embodiment of the present invention initializes the second node N2 and the anode electrode of the organic light emitting diode OLED, using the fourth transistor, which is diode-connected. Other aspects of the driving method are the same as the pixel shown in FIG. 5 and the detailed description thereof is not provided.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A method of driving an organic light emitting display device comprising a plurality of pixels, each of the pixels comprising an organic light emitting diode, a driving transistor for controlling an amount of current supplied to the organic light emitting diode, and an initializing transistor coupled to a gate electrode of the driving transistor, the method comprising:

initializing, concurrently, the gate electrodes of the driving transistors and the anode electrodes of the organic light emitting diodes of the pixels during a reset period;

charging, concurrently, a second capacitor of each of the pixels with a voltage corresponding to a threshold voltage of the corresponding driving transistor during a threshold voltage compensation period;

selecting the pixels of each horizontal line and charging a first capacitor of each of the pixels with a voltage corresponding to a corresponding data signal of the data signals during a scan period; and producing light in accordance with the amount of current supplied to a second power driver from a first power driver through the organic light emitting diode in accordance with the voltages of the first capacitor and the second capacitor during an emission period, wherein the voltages of the gate electrodes of the driving transistors are initialized to a reset voltage by turning on the initializing transistor during the reset period, and wherein a high voltage level of the second power driver is supplied during the reset period, the threshold voltage compensation period, and the scan period and a low voltage level of the second power driver is supplied during the emission period.

2. The method as claimed in claim 1, wherein one frame period comprises the reset period, the threshold voltage compensation period, the scan period, and the emission period.

3. The method as claimed in claim 1, wherein an n-th frame displays a left-eye image and an n+1-th frame displays a right-eye image, with respect to a frame sequentially processed.

4. The method as claimed in claim 3, wherein the entire time between an emission period of the n-th frame and an emission period of the n+1-th frame is synchronized with a response time of shutter spectacles.

5. A method of driving an organic light emitting display device comprising a plurality of pixels, each of the pixels comprising an organic light emitting diode, a driving transistor for controlling an amount of current supplied to the organic light emitting diode, and an initializing transistor coupled to a gate electrode of the driving transistor, the method comprising:

initializing, concurrently, the gate electrodes of the driving transistors and the anode electrodes of the organic light emitting diodes of the pixels during a reset period;

charging, concurrently, a second capacitor of each of the pixels with a voltage corresponding to a threshold voltage of the corresponding driving transistor during a threshold voltage compensation period;

selecting the pixels of each horizontal line and charging a first capacitor of each of the pixels with a voltage corresponding to a corresponding data signal of the data signals during a scan period; and producing light in accordance with the amount of current supplied to a second power driver from a first power driver through the organic light emitting diode in accordance with the voltages of the first capacitor and the second capacitor during an emission period, wherein the voltages of the gate electrodes of the driving transistors are initialized to a reset voltage by turning on the initializing transistor during the reset period, and wherein a low voltage level of the first power driver is supplied during the reset period and a high voltage level of the first power driver is supplied during the other periods.

6. The method as claimed in claim 5, wherein one frame period comprises the reset period, the threshold voltage compensation period, the scan period, and the emission period.

7. The method as claimed in claim 5, wherein an n-th frame displays a left-eye image and an n+1-th frame displays a right-eye image, with respect to a frame sequentially processed.

8. The method as claimed in claim 7, wherein the entire time between an emission period of the n-th frame and an emission period of the n+1-th frame is synchronized with a response time of shutter spectacles.

9. A method of driving an organic light emitting display device comprising a plurality of pixels, each of the pixels comprising an organic light emitting diode, a driving transistor for controlling an amount of current supplied to the organic light emitting diode, and an initializing transistor coupled to a gate electrode of the driving transistor, the method comprising:

initializing, concurrently, the gate electrodes of the driving transistors and the anode electrodes of the organic light emitting diodes of the pixels during a reset period;

charging, concurrently, a second capacitor of each of the pixels with a voltage corresponding to a threshold voltage of the corresponding driving transistor during a threshold voltage compensation period;

selecting the pixels of each horizontal line and charging a first capacitor of each of the pixels with a voltage corresponding to a corresponding data signal of the data signals during a scan period; and producing light in accordance with the amount of current supplied to a second power driver from a first power driver through the organic light emitting diode in accordance with the voltages of the first capacitor and the second capacitor during an emission period, wherein the voltages of the gate electrodes of the driving transistors are initialized to a reset voltage by turning on the initializing transistor during the reset period, and wherein the reset voltage is the low voltage level of the first power driver.

10. The method as claimed in claim 9, wherein one frame period comprises the reset period, the threshold voltage compensation period, the scan period, and the emission period.

11. The method as claimed in claim 9, wherein an n-th frame displays a left-eye image and an n+1-th frame displays a right-eye image, with respect to a frame sequentially processed.

12. The method as claimed in claim 11, wherein the entire time between an emission period of the n-th frame and an emission period of the n+1-th frame is synchronized with a response time of shutter spectacles.

* * * * *